US005732935A

United States Patent [19]

Codario, Jr.

[11] Patent Number: 5,732,935

[45] Date of Patent: Mar. 31, 1998

[54] GOLF BARRIER CROSS BRACING SYSTEM

[76] Inventor: Samuel C. Codario, Jr., 303 13th St., Hammonton, N.J. 08037

[21] Appl. No.: 695,295

[22] Filed: Aug. 9, 1996

[51] Int. Cl.[6] ..... E04M 17/00

[52] U.S. Cl. ..... 256/1; 256/31; 256/35

[58] Field of Search ..... 256/1, 32, 35, 256/36, 24, 19, 12.5, 31, DIG. 3, 47

[56] References Cited

U.S. PATENT DOCUMENTS

| | | | |
|---|---|---|---|
| 2,450,125 | 9/1948 | Dunfee | 273/35 |
| 2,805,070 | 9/1957 | Waters | 273/181 |
| 2,813,197 | 11/1957 | Hubbard et al. | 256/12.5 X |
| 2,895,737 | 7/1959 | Blees | 273/26 |
| 3,001,795 | 9/1961 | Johnson, Jr. | 273/181 |
| 3,222,067 | 12/1965 | Litwhiler et al. | 273/26 |
| 3,504,912 | 4/1970 | Jenney | 273/35 |
| 3,690,675 | 9/1972 | Conklin | 273/185 R |
| 3,797,827 | 3/1974 | Child | 256/1 X |
| 4,380,327 | 4/1983 | Fish | 256/24 |
| 4,756,511 | 7/1988 | Wright, III | 256/12.5 |
| 4,819,915 | 4/1989 | Cargnel | 256/12.5 |
| 4,928,929 | 5/1990 | Kinder | 256/24 |
| 5,116,056 | 5/1992 | Schmutte | 273/181 |
| 5,299,781 | 4/1994 | Barrett et al. | 256/12.5 |
| 5,435,524 | 7/1995 | Ingram | 256/12.5 |

FOREIGN PATENT DOCUMENTS

| | | | |
|---|---|---|---|
| 2669047 | 5/1992 | France | 256/12.5 |
| 6-57712 | 3/1994 | Japan | 256/12.5 |
| 586266 | 8/1969 | U.S.S.R. . | |

OTHER PUBLICATIONS

2192, Sep. 1863, 256/36.

*Primary Examiner*—Harry C. Kim

*Attorney, Agent, or Firm*—Lennox & Murtha, P.A.

[57] ABSTRACT

A wind protection mechanism on a barrier netting installation with sections of vertical poles 25 to 100 high set in ground along a line supported by guy wires to the ground with a horizontal top cable on which the polypropylene netting is draped and attached, with protection improvements including a section of chain link fencing with ends attached to the poles a top edge attached to the lower edge of the netting leaving the lower edge to the fencing to lift off the ground in high winds, and providing horizontal wind lines on one side of the netting and cross wind lines on the other side, and providing the intermediate poles with brackets that allow the horizontal lines to hang so as move horizontally in the wind.

9 Claims, 6 Drawing Sheets

GOLF BARRIER CROSS BRACING SYSTEM

BACKGROUND OF THE INVENTION

This invention involves netting used around golf courses and driving ranges and, more particularly, involves protection mechanisms to protect against wind damage.

With space becoming more and more a premium, the use of tall netting installations which serve to protect other golfers or persons relatively close to the golfing areas. Common uses include protection to reduce the risk of persons on a tee area from being struck by a golf ball hit to a nearby green from an adjacent fairway. It is commonly necessary to erect tall netting barricades between golf fairways and adjacent roadways to protect passing automobiles and other persons in the roadway. It is generally necessary to utilize netting on the sides and sometimes at the ends of driving ranges, not only for safety but also to keep the balls within a restricted area for easy pick up and reuse.

These installations are constructed on poles, not unlike telephone poles which are almost always at least 25 feet high, are commonly 50 to 60 feet high and may reach 80 to 100 feet high. Polymeric plastic netting, such as polypropylene, chosen with resistance to ultra violet radiation and good weather resistance with openings of about three-quarters of an inch which easily stops a stray golf ball even traveling at a high velocity is commonly used in these installations. The poles are typically spaced about fifty feet apart and are held upright by guy cables attached close to the upper ends of the poles and angled downwardly to a ground anchor to provide as much stability against high winds as possible. The netting is attached to the poles with an upper edge attached close to the upper ends of the poles on horizontals cables strung from pole to pole.

A major problem with these installations is damage caused by high winds. Even though the netting is relatively open, the huge expanse of netting, sometimes one hundred feet high and hundreds of feet long, create huge stresses on the netting, the attachments of the netting to the poles and the poles themselves. Further, shifting and gusting winds can increase the stress substantially. A number of various fence mechanisms have been disclosed in the prior art, but few address this problem and none satisfy the needs of the industry.

A net in a game apparatus strung between two poles with a guy wire is disclosed in U.S. Pat. No. 2,450,125 to Dunfee. In a recreational area installation described in U.S. Pat. No. 3,504,912 to Jenney, a plurality of flexible net sections are stretched between adjacent cables with their margins secured to the cables. These net sections cover substantially the entire recreation area apparently using standard techniques. In a ball catcher described in U.S. Pat. No. 2,805,070 to Waters, a heavy fabric skirt hangs from the ball catcher to the ground. A golf game described in U.S. Pat. No. 3,690,675 to Conklin, utilizes a net supported by parallel horizontal rods. In U.S. Pat. No. 2,895,737 to Blees, a ball catcher is disclosed using a netting. In Soviet Disclosure No. SU-586-266 to Belokonev, a storable fence utilizing horizontal and cross lengths of barbed wire is disclosed as an open fence. Somewhat similarly, in U.S. Pat. No. 5,299,781 to Barrett, et al, a cyclone fence is disclosed with parallel horizontal cables, as well as cross cables, extending from post to post all on the same side of a chain link fence. In U.S. Pat. No. 5,116,056 to Schmutte, an indoor golf practice apparatus utilizes netting hung from an "L" shaped horizontal rail. In U.S. Pat. No. 4,819,915 to Cargnel, a flexible barrier for arresting falling rocks is constructed on posts set in the ground with parallel horizontal cables strung between the posts. A silt fence is described in U.S. Pat. No. 4,756,511 to Wright, III, with fabric secured to stakes driven in the ground. A draped webbed target device is disclosed in U.S. Pat. No. 3,227,449 to Schwab, wherein the netting is hung from a horizontal tubular frame. In U.S. Pat. No. 3,222,067 to Litwhiler, et al, a baseball batting cage is described with netting hung from a tubular box-type frame. In U.S. Pat. No. 3,001,795 to Johnsen, Jr., a golf practice device is disclosed utilizing netting supported on a tubular frame.

None of these devices satisfy the needs and problems described herein above nor attain the objects described herein below.

SUMMARY OF INVENTION

It is an object of the protection sought to provide a netting construction that will resist damage due to high winds and particularly to gusting winds.

It is a particular object of the protection sought to provide a structure to support netting to a great height which, when subjected to wind velocities higher than that which the installation is designed to withstand, will not be destroyed entirely but will only require minimal repair.

It is a particular object of the protection sought to provide a mechanism which buffers the effect of gusting winds utilizing a shock absorbing structure to absorb a major portion of the force of the initial gusts before exerting maximum strain to the netting structure.

It is a particular object of the protection sought to provide a mechanism which will reduce the strain on the attachment means to attach the netting to the poles due to high winds from any direction.

It is a specific object of the protection sought to provide a connection mechanism to connect the netting to the poles while connecting the supporting cable to the poles in a fashion that allows for failure of that connection as opposed to failure of the poles or destruction of the netting.

An aspect of the invention is a wind protection mechanism on a barrier netting installation that includes a multiplicity of vertical poles set in ground along a line, each pole being at least twenty-five feet high, guy means attached to upper ends of the poles and to the ground to provide support for the poles, and netting attached by means to the poles, the netting comprising an upper edge attached proximate the upper ends of the poles, preferably a foot or two from the top, and a height extending downwardly from the upper edge toward the ground to a lower edge. The wind protection mechanism includes a section of chain link fencing that includes a length proximate to that of the lower edge of the netting, a height proximate a height of the lower edge of the netting extending upwardly from a lower lengthwise edge to an upper lengthwise edge, and two ends. The wind protection mechanism further includes fence attachment means to attach the ends of the section of chain link fence to the poles allowing the lower lengthwise edge to swing free, and means to attach the upper edge of the section of chain link fence to the lower edge of the netting.

It is preferred that the fence attachment means and the means to attach the upper edge of the section of chain link fence to the lower edge of the netting include a first horizontal cable tautly connected between the poles at a height proximate the upper lengthwise edge of the section of the chain link fence, a second horizontal cable tautly connected between the poles at a height proximate the lower lengthwise edge of the section of the chain link fence, means to attach the lower edge of the netting and the upper lengthwise edge of the fence to each other and to the first horizontal cable, and means to attach the lower lengthwise edge of the fence to the second horizontal cable. It is more preferred that the means to attach the lower edge of the netting and the upper lengthwise edge of the fence to each other and to the first horizontal cable include lacing the first horizontal cable through openings in the netting and attaching the chain link fence to said cable with hog rings spaced along the length of the cable. It is also preferred that the mechanism of further first cable trained on a first side of the netting attached between an upper end of a first pole and lower section of an adjacent second pole, a second cable trained on the first side of the netting crossing the first cable attached between an upper end of the second pole and lower section of the first pole, and a plurality of horizontal third cables trained between the first and second poles on a second side of the netting opposite the first side, each of the third cables comprising ends attached to the first and second poles, wherein the horizontal third cables are spaced vertically from each other no further apart than about ten to about fifteen feet, and wherein there is no attachment between the netting and the cables between the poles.

Another aspect of the invention is a wind protection mechanism on a barrier netting installation that includes a multiplicity of vertical poles set in ground along a line, each pole being at least sixty feet high from a lower section proximate the ground to an upper end, guy means attached to the upper ends of the poles and to the ground to provide support for the poles, and netting attached by means to the poles, the netting comprising an upper edge attached proximate the upper ends of the poles and a height extending downwardly from the upper edge toward the ground to a lower edge. The wind protection mechanism includes a first cable trained on a first side of the netting attached between an upper end of a first pole and a median position of an adjacent second pole, a second cable trained on the first side of the netting crossing the first cable attached between an upper end of the second pole and a median position of the first pole, a third cable trained on the first side of the netting attached between the median section of a first pole and a bottom position of an adjacent second pole proximate the ground, a fourth cable trained on the first side of the netting crossing the third cable attached between the median section of a second pole and a bottom position of the first pole proximate the ground, and a plurality of horizontal third cables trained between the first and second poles on a second side of the netting opposite the first side, each of the third cables comprising ends attached to the first and second poles, wherein the horizontal third cables a spaced vertically from each other no further apart than about fifteen feet, and wherein there is no attachment between the netting and the cables between the poles. It is preferred that the mechanism described immediately above further include the section of chain link fencing described herein above.

Yet another aspect of the invention is a wind protection mechanism on protection netting that includes a multiplicity of vertical poles set in ground along a line, each pole being at least twenty-five feet high from a lower section proximate the ground to an top section, the vertical poles comprising at least a group of three poles consisting of two end poles and at least one middle pole, guy means attached to the top section of the poles and to the ground to provide support for the poles, an upper horizontal cable at a height proximate the top section to the poles, and netting attached by means to the upper horizontal cable and attached by means to the end poles, the netting comprising an upper edge attached proximate the top sections of the poles and a height extending downwardly from the upper edge toward the ground to a lower edge. The wind protection mechanism includes the upper horizontal cable including two cable ends, one cable end attached to the top section of one of the end poles of the group of three poles and a remaining cable end attached to the top section of a remaining end pole of the section, and connection means to hang a median section of the upper horizontal cable to the top section the middle poles, the means comprising a bracket attached to the middle poles comprising means to hang the median section to the upper horizontal cable and a median section of the upper edge of the net on the bracket while allowing the cable and netting to move horizontally in the bracket.

It is preferred that the mechanism further include a screen patch of heavier gauge and of finer mesh than that the netting and of the same composition as the netting that is draped over the median section of the upper edge of the netting and positioned the means to hang the cable. It is also preferred that said mechanism of further include a section of chain link fencing as described herein above. It is most preferred that the mechanism include all the improvements described herein above.

DESCRIPTION OF PREFERRED EMBODIMENTS

Figure 1:
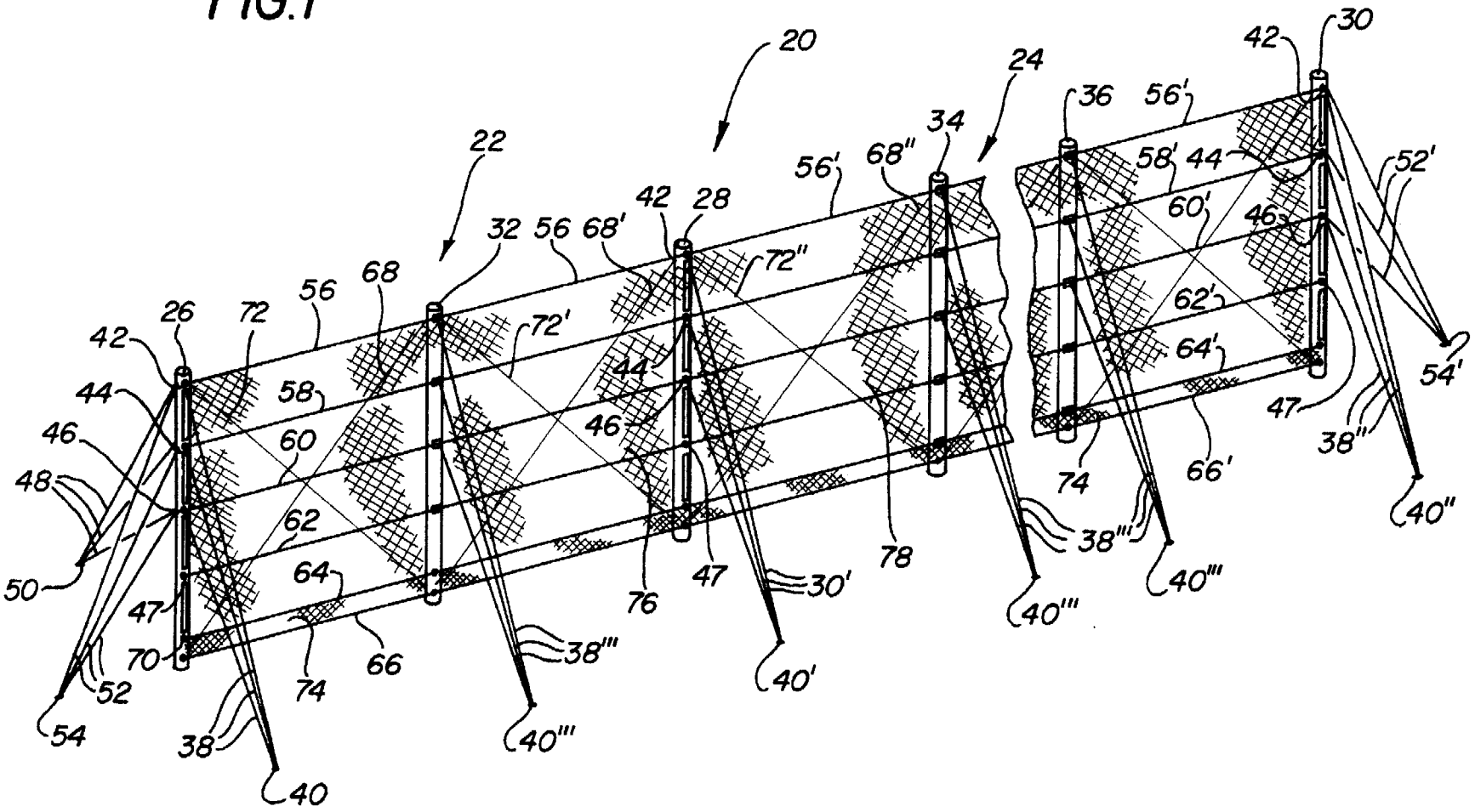
FIG. 1 is a perspective diagram of a barrier net installation of the present invention.

Barrier net installation 20 is pictured in FIG. 1, and portions are shown in the later drawings. Installation 20 is about fifty feet high and about two hundred and fifty feet long supporting sections 76 and 78 of standard one inch mesh No. 1415 polypropylene net with an eight per cent wind load from Texnet, Inc. suitable for stopping golf balls. Higher and lower installations are constructed in a similar fashion. Installations hundred feet high essentially include two fifty foot installations, one on top of the other, as diagrammed in FIG. 6. Higher installations require thicker poles. In installations higher than 50 feet, the barrier net is installed in two vertically positioned sections, each section being one half of the height of the installation. The horizontal adjoining edges are hog ringed and laced together.

Installation 20 includes section 22 between pull poles 26 and 28 with hang pole 32 in between. The balance of installation 20 is section 24 which extends between pull poles 28 and 30 with hang poles 34 and 36 in between. Each of the Class II poles are about sixty feet long with the lower end extending about eight and one half feet into the ground. Lateral front guy lines 38, 38' and 38" extend frontwardly and at right angles to the line of installation 20 from ground anchors 40, 40' and 40" up to T-brackets at line attachment height 42 about a foot from the top of pull poles 26, 28 and 30, line attachment height 44 on the poles about thirty seven and a half feet above ground level, and line attachment height 46 on the poles about twenty five feet above ground level. All cables and lines(these words being used interchangeably throughout the specification and claims), unless otherwise noted, are one quarter inch diameter seven by nineteen strand standard airplane cable. Similarly, rear lateral guy lines 48 extend upwardly from ground anchor 50 to attachment heights 42, 44, and 46 which are also equipped with T-brackets attached by bolts through pole 26. Similar guy lines also extend laterally at right angles toward the rear from pull poles 28 and 30, but are hidden in this view. Longitudinal guy lines 52 and 52' extend from the left and right ends of installation 20 along the line of the installation from ground anchors 54 and 54' to T-brackets at attachment heights 42, 44, and 46 on poles 26 and 30. Guy wires are used on all poles in installations fifty foot and above while most installations fifty foot and below have guy wires only on the pull poles. Barrier netting 76 hangs on top line 56 spanning between brackets at attachment height 42 on pull poles 26 and 28. Line 56 hangs eighteen inches from the top on a bracket slightly below attachment height 42 on the front of hang pole 32. Likewise, netting 78 hangs on top line 56' which spans from a bracket below attachment height 42 on pull pole 28 and at the other end to a similar bracket on pull pole 30. In section 24, top line 56', as well as all other horizontal lines hang on brackets on the front of hang poles 34 and 36. Horizontal wind lines 58, 60, 62, and 64 span between and are attached to the front of pull poles 26 and 28 at attachment heights 44, 46, 47 (at twelve and a half feet above ground), and 70 (at forty-four inches above ground), respectively. All of these wind lines extend on the front face of installation 20 and hang on brackets on hang pole 42 at the respective heights. Unless noted, the horizontal wind lines are attached to the hang poles with a single bolt clamp with is attached over a one foot square heavy wind screen patch with a hole cut away at the center to allow movement of the barrier netting around the bolt area. The screen patch is nailed with roofing nails to the pole. The wind lines provide tension in opposite directions keeping equal pressure on the poles during high winds. Lower wind line 64 also acts as the top line for chain link fence 74 which hangs on that line. Bottom line 66 extends between the pull poles a few inches above the ground and supports the bottom of chain link fence 74. Cross line 72 is attached to eye-brackets attached to the inside sides of the poles behind the netting and extends between a height one foot from the top just above attachment height 42 on the top of pole 26 to line attachment height 71 about a foot and half above ground. Likewise, cross line 68 is attached to a T-bracket above height 42 at the side of pole near the top of pole 32 and at the other end to attachment height 73 on pole 26. Cross lines 68 and 72 extend across the rear face of net 76. Each cross line spans between adjacent poles is supported and attached likewise.

Figure 2:
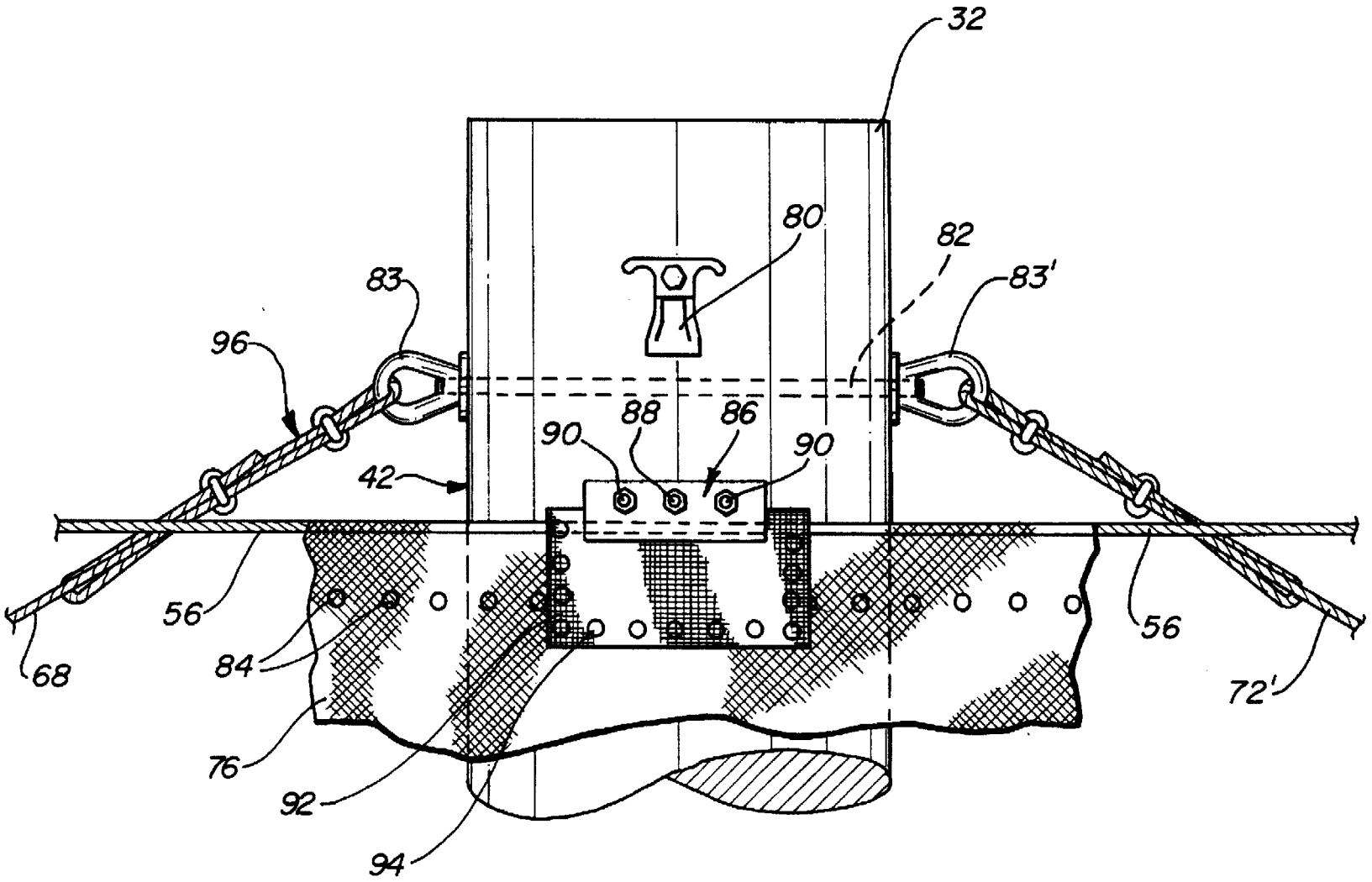
FIG. 2 is a partial cutaway front view of the top of a hang pole shown in FIG. 1.

In FIG. 2, the top of hang pole 32 is illustrated where netting 76 is draped over top line 56 and the overlapped section is attached every three inches along the upper length with hog rings 84. Cable 56 hangs on three hole clamp 86 which is shown in the exploded view of FIG. 4. Clamp 86 is attached to pole 32 by bolt 88 which extends through the pole to the rear. Clamp 86 is held together by bolts 90 to support cable 26 and also sandwich the upper edge of netting 76 draped over the cable while one foot square reinforcing patch 92 of heavy fine mesh polypropylene wind screen, which drapes over the upper edge of the netting under clamp 86 and is nailed to pole 32 with roofing nails 94. The top end of cross lines 68 and 72' are attached by a pig-tail cable connecting means 96 as illustrated to threaded five-eighth inch eye nut brackets 83 which are threaded onto threaded stud 82 extending through pole 32.

Figure 3:
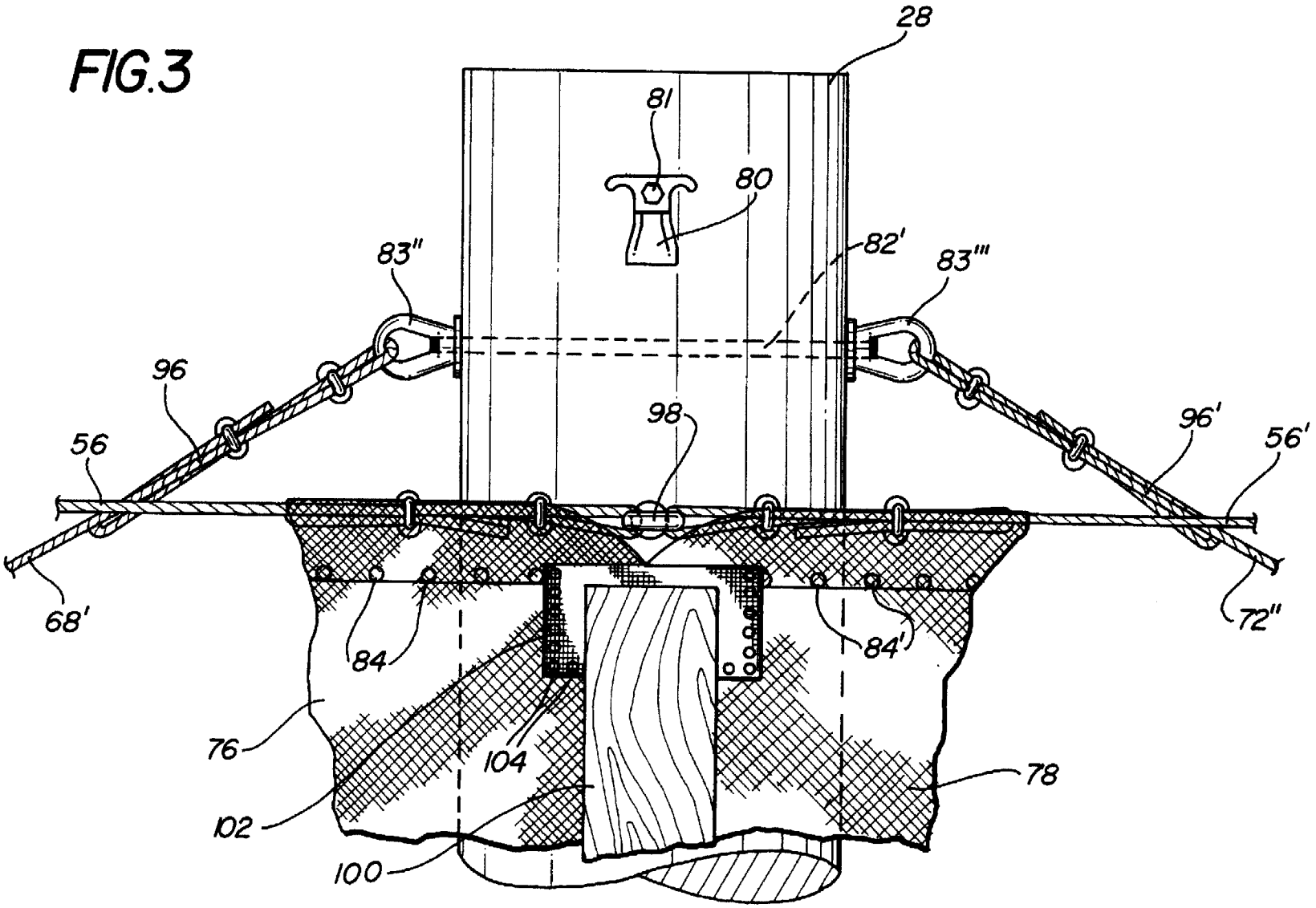
FIG. 3 is a partial cutaway front view of the top of a pull pole shown in FIG. 1.

FIG. 3 illustrates the top section of pull pole 28 showing connection of barrier net 76 from one side and barrier net 78 from the other. Cross lines 68' connected through a cable tie connection 96 to threaded eye-bracket 83" threaded on stud 82' which extends through pole 28 to an opposite end on which threaded eye bracket 83" is threaded and to which is connected through a cable tie connection 96 to cross line 72" which extends downwardly and connects to the bottom of pole 34. Threaded eye-bracket 98 provides connection of the ends of cables 56 and 56' to pull pole 28. As shown in FIG. 2, barrier net 76 hangs on top line 56 by draping over the line and connected by hog rings 84 connected about three inches apart. Likewise, barrier net 78 drapes over line 56' and the overlap is connected through hog rings 84'. Attachment of the vertical edge of the net to the pull pole temporarily uses nails to require appropriate tension. Once boards 100 are attached, the nails are removed and the excess barrier net is cut away. The vertical right edge of barrier net 76, as well as the vertical left edge of barrier net 78, is attached to pole 28 by one inch by four inch cedar wood planks 100 which are placed over sandwiching the net against the front surface of pole 28. Wood planks 100 are attached through the center with number eight nails to pole 28 and also sandwiching at their upper and lower ends wind screen patches 102 and 102' respectively(the latter shown in FIG. 5) which are further attached to pole 28 with roofing nails 104. T-bar bracket 80 is installed by bolt 81 extending through pole 28. Although no shown here, the upper end of guy line 38' is connected by pig tail connection 96 to bracket 80 and that line extends all the way down to ground anchor 40'. This type of bracket is used for all guy lines at the various heights.

Figure 4:
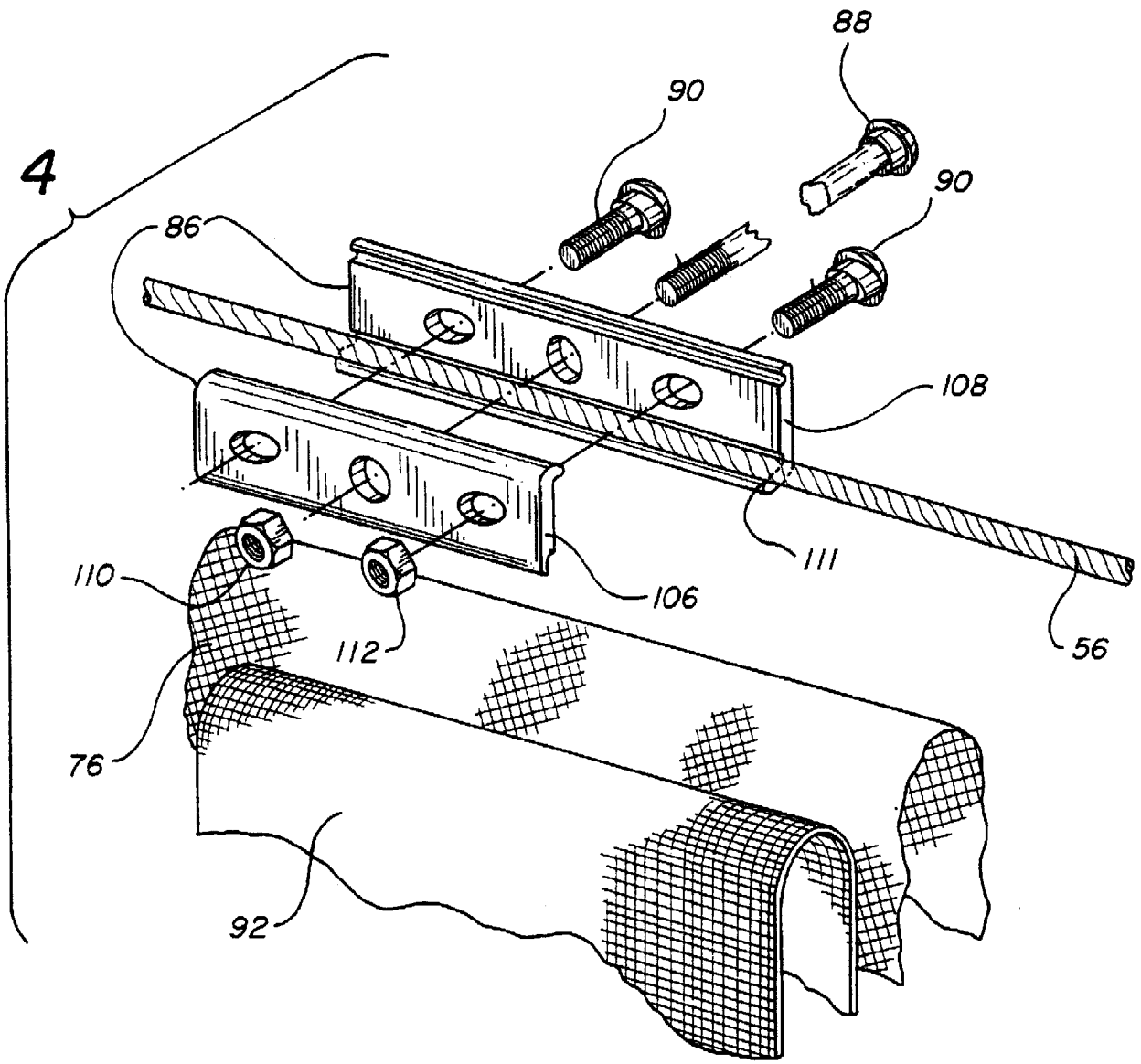
FIG. 4 is a perspective exploded view of the bracket attachment illustrated in FIG. 2.

FIG. 4 is an exploded view of the bracket and net connection at the top of hang pole 32 as shown in FIG. 2. Three hole bracket 86 consists of front bracket section 106 and rear bracket section 108 which nest against each other providing internal shelf 111 which supports cable 56 around which are draped barrier net 76 and foot square wind screen patch 92. Bracket 86 is attached to pole 32 by bolt 88 which extends through the pole to the rear and through the center hole of bracket 86 onto which is tightened nut 110. Two bolts 90 extend through the two end holes of bracket 86 and are secured by nuts 112.

Figure 5:
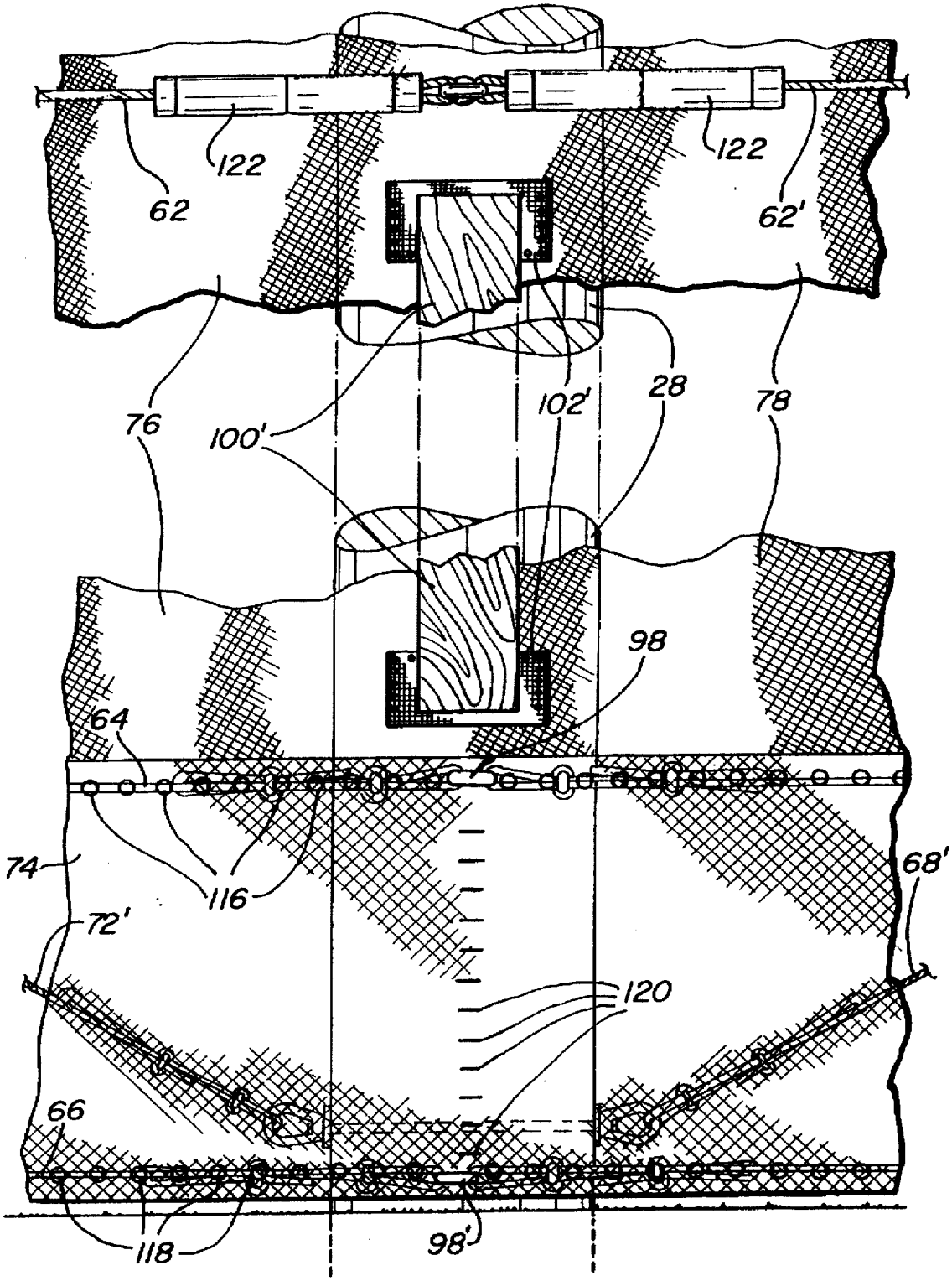
FIG. 5 is an enlarged front view of a lower section of the installation illustrated in FIG. 1.

FIG. 5 is an enlarged view of the base section of pull pole 28 showing the attachment of chain link fence 74 which extends uninterrupted the full length of installation 20. The chain link fence material is four feet high, one and one-quarter inch by one and one-quarter inch grid nine gauge vinyl coated chain link fencing. The upper edge of fence 74 is connected to the bottom edge of barrier net 76 as well as lower wind line 64, which is attached to eye bolt 98 on the front of pole 28. Line 64 is laced through the barrier net openings and the combination of the cable and net are attached to the fence about two to four inches from the upper edge of chain link fence 74 with hog rings 116 spaced about three inches apart. Barrier net 78 is likewise connected to line 64 and fence 74 from the opposite side of pole 28. The bottom of fence 74 is connected to bottom horizontal line 66 connected to eye bolt 98' on the front near the base of pole 28. Again, the lower edge of fence 74 is connected to cable 66 with hog rings 118. U-nails 120 are driven into pole 28 over intersections of the chain link mesh. The chain link fence is under tension, but the fifty foot span allows the fence in high winds to be lifted off of the ground and provide a shock absorbing effect to the installation. Similar to the construction at the top of pole 28, plank 100' traps the vertical edges of barrier nets 76 and 78 between it and pole 28. Wind screen patch 104' is placed over the net under board 100' and nailed in place to provide reinforcement. Lines 62 and 62' span between the poles in front of netting 76 and 78 respectively, and attach to an eye bolt on the front of hang pole 28. The cable connections are covered with foam wrap 122 to reduce abrasion of the net.

Figure 6:
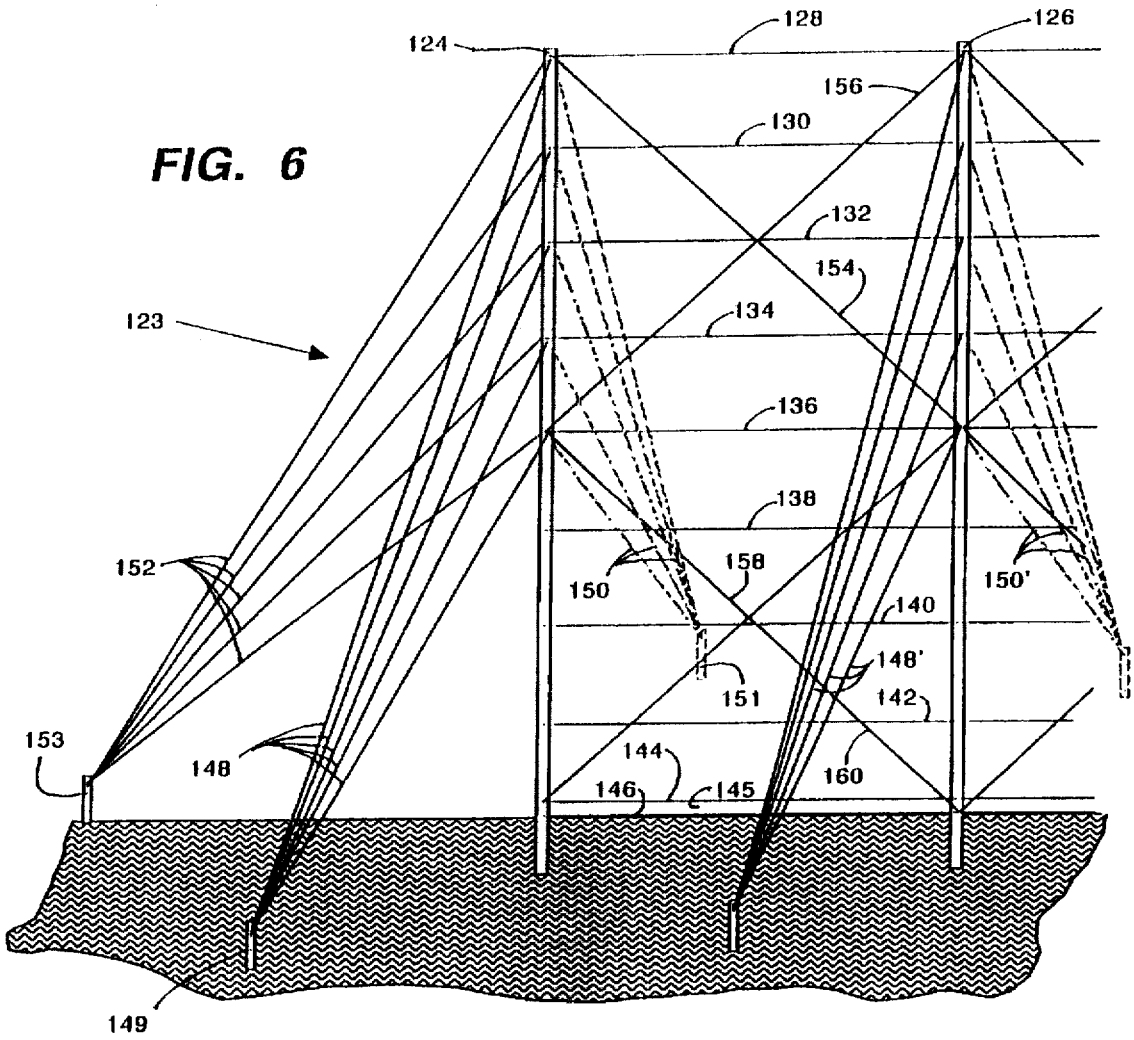
FIG. 6 is front view diagram of a section of a second embodiment of an installation of the present invention.

A diagram of the poles and cable configuration of an end section of installation 123 that supports a one hundred foot high barrier netting is provided in FIG. 6. Horizontal wind lines attach to pull pole 124 and hang on hang pole 126, each of the poles being about one hundred and ten feet long. The heights of horizontal wind lines 128, 130, 132, 134, 136, 138, 140 and 142 are 100 feet, 87.5 feet, 75 feet, 62.5 feet, 50 feet, 37.5 feet, 25 feet and 12.5 feet, respectively spanning between poles 124 and 126. The attachment of these horizontal wind lines is similar to that of the installation described in FIGS. 1 through 5 as pole 124 is a pull pole and pole 126 is a hang pole. Horizontal line 144 is attached to the poles similarly and is attached along its length by weaving to the netting (not shown) and by hog rings to the upper edge of chain link fence 145. Horizontal line 146 is attached to the poles and is attached along its length by hog rings to the lower edge of chain link fence 145. Guy lines 148 extend laterally frontwardly at a slight angle toward the end from ground anchor 149 up to connections to pole 124 at heights 50 feet, 62.5 feet, 75 feet, 87.5 feet, and 100 feet. Guy lines 150 extend laterally rearwardly at a slight angle toward the end from ground anchor 151 up to connections to pole 124 at the same heights. Guy lines 152 extend longitudinally along the line of the installation from ground anchor 153 up to connections to pole 124 at the same heights. At this height lateral guy lines 148' and 150' similarly support hang pole 126 at the same heights as on pole 124. Cross wind line 154 is connected to pole 124 just above the 100 foot height and to pole 126 close to the 50 foot height, while cross line 156 is connected to pole 126 just above the 100 foot height and to pole 124 close to the 50 foot height. Cross line 158 is connected to pole 124 close to the 50 foot height and to pole 126 at a one and half foot height, while cross line 160 is connected to pole 126 close to the 50 foot height and to pole 124 at a one and half foot height. The cross lines are to the rear of the net and the horizontal wind lines are to the front of the net. The netting hangs from the top horizontal line and is attached to the poles and to the top the fence, but is merely sandwiched between the horizontal and the cross wind lines. The pattern is repeated for each section of cable connections between poles for the entire installation.

While this invention has been described with reference to specific embodiments disclosed herein, it is not confined to the details set forth and the patent is intended to include modifications and changes which may come within and extend from the following claims.

I claim:

1. A wind protection mechanism on a barrier netting installation that comprises:

(A) a multiplicity of vertical poles set in ground along a line, each pole being at least twenty-five feet high and having an upper end and a lower section, (B) guy means attached to upper ends of the poles and to the ground to provide support for the poles, and (C) netting attached to the poles, the netting comprising an upper edge attached proximate the upper ends of the poles at an upper height and extending downwardly from the upper edge toward the ground to a lower edge at a lower height, the wind protection mechanism comprising:

(a) a section of chain link fence comprising:

(i) an upper longitudinal edge proximate to the lower edge of the netting, (ii) a latitudinal edge proximate to the lower edge of the netting and extending downwardly from the upper longitudinal edge to a lower longitudinal edge, and (iii) two ends, (b) fence attachment means to attach the ends of the section of chain link fence to the poles allowing the lower longitudinal edge to swing free, and (c) means to attach the upper longitudinal edge of the section of chain link fence to the lower edge of the netting.

2. The mechanism of claim 1 wherein the fence attachment means and the means to attach the upper longitudinal edge of the section of chain link fence to the lower edge of the netting comprises:

(a) a first horizontal cable tautly connected between the poles at a height proximate the upper longitudinal edge of the section of chain link fence, (b) a second horizontal cable tautly connected between the poles at a height proximate the lower longitudinal edge of the section of chain link fence, (c) means to attach the lower edge of the netting and the upper longitudinal edge of the section of chain link fence to each other and to the first horizontal cable, and (d) means to attach the lower longitudinal edge of the section of chain link fence to the second horizontal cable.

3. The mechanism of claim 2 wherein the means to attach the lower edge of the netting and the upper longitudinal edge of the section of chain link fence to each other and to the first horizontal cable comprises lacing the first horizontal cable through openings in the netting and attaching the section of chain link fence to the first horizontal cable with hog rings spaced along the length of the first horizontal cable.

4. The mechanism of claim 1 further comprising:

(a) a first cable trained on a first side of the netting attached between an upper end of a first pole and lower section of an adjacent second pole, (b) a second cable trained on the first side of the netting crossing the first cable attached between an upper end of the second pole and lower section of the first pole, and (c) a plurality of horizontal third cables trained between the first and second poles on a second side of the netting opposite the first side, each of the third cables comprising ends attached to the first and second poles, wherein the horizontal third cables are spaced vertically from each other no further apart than about ten to about fifteen feet, and wherein there is no attachment between the netting and the cables.

5. (Amended) A wind protection mechanism on protection netting that comprises:

(A) a multiplicity of vertical poles set in ground along a line, each pole being at least sixty feet high from a lower section proximate the ground to an upper end, including at least a first pole and a second pole, wherein the first pole is adjacent to the second pole, (B) guy means attached to the upper ends of the poles and to the ground to provide support for the poles, and (C) netting attached to the first pole and the second pole, the netting comprising an upper edge attached proximate the upper ends of the first pole and second pole and a height extending downwardly from the upper edge toward the ground to a lower edge, the wind protection mechanism comprising:

(a) a first cable trained on a first side of the netting attached between an upper end of the first pole and a median position of the second pole, (b) a second cable trained on the first side of the netting crossing the first cable attached between an upper end of the second pole and a median position of the first pole, (c) a third cable trained on the first side of the netting attached between the median position of the first pole and a bottom position of the second pole proximate the ground, (d) a fourth cable trained on the first side of the netting crossing the third cable attached between the median section of the second pole and a bottom position of the first pole proximate the ground, and (e) a plurality of horizontal third cables trained between the first and second poles on a second side of the netting opposite the first side, each of the third cables comprising ends attached to the first pole and the second pole, wherein the horizontal third cables are spaced vertically from each other no further apart than about fifteen feet, and wherein there is no attachment between the netting and the cables.

6. The mechanism of claim 5 further comprising:

(a) a section of chain link fence comprising:

(i) an upper longitudinal edge to the lower edge of the netting, (ii) a latitudinal edge proximate to the lower edge of the netting extending downwardly from the upper longitudinal edge to a lower longitudinal edge, and (iii) two ends, (b) fence attachment means to attach the ends of the section of chain link fence to the poles allowing the lower longitudinal edge to swing free, and (c) means to attach the upper longitudinal edge of the section of chain link fence to the lower edge of the netting.

7. A wind protection mechanism on protection netting that comprises:

(A) a multiplicity of vertical poles set in ground along a line, each pole being at least twenty-five feet high from a lower section proximate the ground to a top section, the vertical poles comprising at least a group of three poles consisting of two end poles and at least one middle pole, (B) guy means attached to the top section of the poles and to the ground to provide support for the poles, (C) an upper horizontal cable at a height proximate the top section to the poles, (D) netting attached to the upper horizontal cable and attached to the end poles, the netting comprising an upper edge attached proximate the top sections of the poles and a height extending downwardly from the upper edge toward the ground to a lower edge, the wind protection mechanism comprising:

(i) the upper horizontal cable comprising two cable ends, one cable end attached to the top section of one of the end poles of the group of three poles and a remaining cable end attached to the top section of a remaining end pole of the group of three poles, and (ii) connection means to hang a median section of the upper horizontal cable to the top section of the middle pole, the connection means comprising a bracket attached to the middle pole and including means to hang the median section of the upper horizontal cable and a median section of the upper edge of the net on the bracket while allowing the cable and netting to move horizontally in the bracket, and (E) a section of chain link fence comprising:

(i) an upper longitudinal edge proximate to the lower edge of the netting, (ii) a latitudinal edge proximate to the lower edge of the netting and extending upwardly from a lower longitudinal edge to an upper longitudinal edge, and (iii) two ends, (F) fence attachment means to attach the ends of the section of chain link fence to the poles allowing the lower longitudinal edge to swing free, and (G) means to attach the upper longitudinal edge of the section of chain link fence to the lower edge of the netting.

8. The mechanism of claim 7 further comprising a screen patch of heavier gauge and of finer mesh than that of the netting and of the same composition as the netting draped over the median section of the upper edge of the netting and positioned proximate to the hanging means.

9. A wind protection mechanism on protection netting that comprises:

(A) a multiplicity of vertical poles set in ground along a line, each pole being at least twenty-five feet high from a lower section proximate the ground to a top section, the vertical poles comprising at least a group of at least three poles including two end poles and at least one middle pole, (B) guy means attached to the top section of the poles and to the ground to provide support for the poles, (C) an upper horizontal cable at a height proximate the top section to the poles, and (D) netting attached to the upper horizontal cable and attached to the end poles, the netting comprising an upper edge attached proximate the top sections of the poles and a height extending downwardly from the upper edge toward the ground to a lower edge, the wind protection mechanism comprising:

(a) the upper horizontal cable comprising two cable ends, one cable end attached to the top section of one of the end poles of the .group of at least three poles and a remaining cable end attached to the top section of a remaining end pole, (b) connection means to hang a median section of the upper horizontal cable to the top section of the middle pole, the means comprising a bracket attached to the middle poles and including means to hang the median section to the upper horizontal cable and a median section of the upper edge of the netting on the bracket while allowing the cable and netting to move horizontally in the bracket, (c) a section of chain link fence comprising:

(i) an upper longitudinal edge proximate to the lower edge of the netting, (ii) a latitudinal edge proximate to the lower edge of the netting and extending upwardly from a lower longitudinal edge to an upper longitudinal edge, and (iii) two ends, (d) fence attachment means to attach the ends of the section of chain link fence to the poles allowing the lower longitudinal edge to swing free, (e) means to attach the upper longitudinal edge of the section of chain link fence to the lower edge of the netting, (f) a first cable trained on a first side of the netting attached between an upper end of a first pole of the group and a median position of a second pole of the group, where the first pole and the second pole are adjacent, (g) a second cable trained on the first side of the netting crossing the first cable attached between an upper end of the second pole and a median position of the first pole, (h) a third cable trained on the first side of the netting attached between the median position of the first pole and a bottom position of a second pole proximate the ground, (i) a fourth cable trained on the first side of the netting crossing the third cable attached between the median section of the second pole and a bottom position of the first pole proximate the ground, and (j) a plurality of horizontal third cables trained between the first and second poles on a second side of the netting opposite the first side, each of the third cables comprising ends attached to the first and second poles, wherein the horizontal third cables are spaced vertically from each other no further apart than about fifteen feet, and wherein there is no attachment between the netting and the cables.

* * * * *